United States Patent [19]

Dumas

[11] Patent Number: 4,460,173

[45] Date of Patent: Jul. 17, 1984

[54] AUTOMATIC APPARATUS FOR POSITIONING FOOTBALLS FOR KICKING

[76] Inventor: Samuel R. Dumas, 215 Oakhurst St., El Dorado, Ark. 71730

[21] Appl. No.: 558,468

[22] Filed: Dec. 6, 1983

Related U.S. Application Data

[62] Division of Ser. No. 273,344, Jun. 15, 1981, Pat. No. 4,424,969.

[51] Int. Cl.[3] ..... A63B 67/00

[52] U.S. Cl. ..... 273/55 B; 124/50

[58] Field of Search ..... 273/55 B, 201; 124/45, 124/47, 49, 50, 51 R

[56] References Cited

U.S. PATENT DOCUMENTS 3,467,380 9/1969 Bonacci ..... 273/55 R 4,424,969 1/1984 Dumas ..... 273/55 R

*Primary Examiner*—Richard C. Pinkham

*Assistant Examiner*—T. Brown

*Attorney, Agent, or Firm*—Stephen D. Carver

[57] ABSTRACT

Automatic devices for positioning footballs for subsequent kicking to aid in kicking practice. The apparatus comprises a hopper for containing a plurality of footballs, which is perferably secured to a supportive base. Set-up apparatus serially receives footballs from the hopper and positions them in an upright, generally vertically end to end oriented position suitable for kicking. The hopper may be inclined with respect to the base to facilitate gravity feed, or it may include football contacting means for forcibly conveying footballs therethrough. In a preferred embodiment the hopper may transversely feed the set-up means. The set-up means may be controlled electrically or pneumatically.

10 Claims, 10 Drawing Figures

AUTOMATIC APPARATUS FOR POSITIONING FOOTBALLS FOR KICKING

Cross Reference to Related Application

This is a division of application Ser. No. 273,344, filed 06/15/81, now U.S. Pat. No. 4,424,969.

Background of the Invention

The present invention is concerned broadly with apparatus adapted to aid in football kicking training. More particularly, the present invention is concerned with the various systems adapted to temporarily store one or more footballs, and thereafter to serially position them for subsequent kicking. It is believed that United States Class 273, Sub-Class 55B is most relevant.

As will readily be appreciated by both football players and others skilled in the sport of football, the requisite proficiency necessary for success demands constant practice of the various skills associated with the game. One important skill involves place kicking. The place kick may be employed to initiate play, or to score field goals or points after touch downs.

The kicking skill is a highly specialized art requiring a great deal of physical and mental concentration and training. Long hours of repetitive kicking practice are demanded for successful mastering of the technique. In the past it has been common practice for footballs to be held by an associate player. Alternatively, apparatus adapted to temporarily hold single footballs for subsequent kicking may be employed.

Examples of prior art football kicking training devices, which are adapted to temporarily hold single footballs for subsequent kicking may be seen in the following U.S. Pat. No.: 3,897,948, issued to R. Gerela on Aug. 5, 1975; U.S. Pat. No. 4,049,267, issued to C. Forrest on Sept. 20, 1977; and U.S. Pat. No. 3,762,706, issued to M. Cavett on Oct. 2, 1973. A related training aid involving a net which is automatically raised to provide a timing interval for kicking training is seen in U.S. Pat. No. 3,836,147, issued to S. Shapiro on Sept. 17, 1974. Less relevant prior art may be seen in U.S. Pat. Nos. 3,602,506 and 3,901,515.

All of the prior art football holding devices known to me require that footballs be manually inserted and/or set-up. Thus, after practicing a kick, typical prior art devices may be manually reloaded. Thus, a great deal of time may be wasted by constantly reloading the apparatus. Particularly in the case of high school or college athletics, for example, the reloading process wastes valuable and limited time available to such athletes for training. Thus a need exists for automatically and repetitively setting up footballs for efficient football kicking practice.

Summary of the Invention

The embodiments of the present invention are adapted to hold one or more footballs in a hopper and to serially set them up for subsequent kicking.

Each embodiment of the present invention preferably comprises a base adapted to be disposed upon the playing surface, and a hopper supported above the base for containing one or more footballs. Set-up apparatus serially receives footballs from the hopper and positions them for subsequent kicking. The hopper may be positioned at an angle relative to the base to facilitate longitudinal, gravity feed of footballs; or, alternatively, the hopper may include a system for forcibly moving footballs therethrough. An important alternative embodiment of the present invention employs a transversely feeding hopper.

Preferably the set-up means includes a resilient finger for extracting footballs serially from the hopper and a cooperating, tensioned guide arm for orienting footballs in a kickable position in cooperation with movement of the finger. The set-up means may be electrically, mechanically, or pneumatically controlled. Preferably the pneumatic embodiment is employed in conjunction with a transverse hopper. In the latter embodiment the set-up means includes a pivoted receptor plate which serially receives footballs from the transverse hopper and pivots to move them into a vertical position. The guide arm means cooperates to align and temporarily maintain footballs in proper kicking position.

Preferably the footballs are disposed upon a switching mechanism, whereby contact with the footballs triggers a switch. The switch, which may be electrical or pneumatic, controls timing of the set-up means to initiate an automatic football feed signal upon kicking.

Therefore a broad object of the present invention is to provide several systems for automatically and continuously setting up footballs to facilitate kicking practice.

A basic object of the present invention is also to provide training systems for improving the skills of football kickers.

Moreover, it is an object of the present invention to provide automatic football feeding and positioning mechanisms which will aid in training kickers in either soccer-style or conventional kicking techniques.

A similar object is to provide automatic feeding and positioning systems of the character described adapted to facilitate kicking of footballs in a variety of trajectories.

A basic object of the present invention is to provide mechanical systems adapted to replace the football holders of current design.

Yet another object of the present invention is to provide football positioning apparatus of the character described which may be successfully employed upon artificial surfaces or natural turf.

A still further object of the present invention is to provide a football positioning apparatus of the character described adapted to be employed upon uneven or rough turf surfaces characteristic of most high school and/or college practice areas.

Another object of the present invention is to provide an automatic football kicking training device which will release the football without adversely affecting travel angle.

Yet another object of the present invention is to provide a football kicking training aid which will automatically feed and position footballs without the use of electricity. An important feature of the present invention is that a pneumatic system for controlling such apparatus is disclosed.

These and other objects and advantages of the present invention, along with features of novelty appurtenant thereto, will appear or become apparent in the course of the following descriptive sections.

Brief Description of the Drawings

In the following drawings, which form a part of the specification and which are to be construed in conjunction therewith, and in which like reference numerals have been employed whereever possible to indicate like parts in the various views.

Detailed Description of the Drawings

Figure 2:
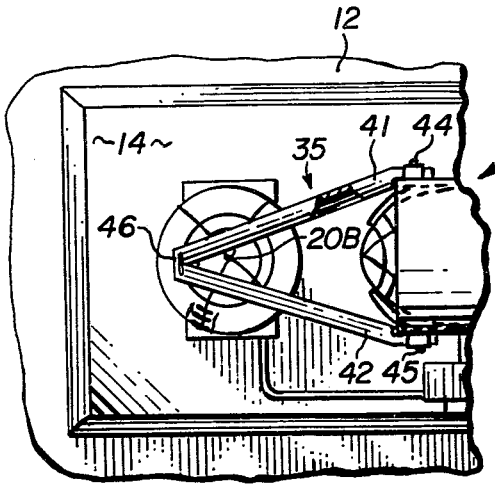
FIG. 2 is a top plan view of the set-up means taken generally along line 2—2 of FIG. 1, with parts thereof broken away for clarity.
Figure 1:
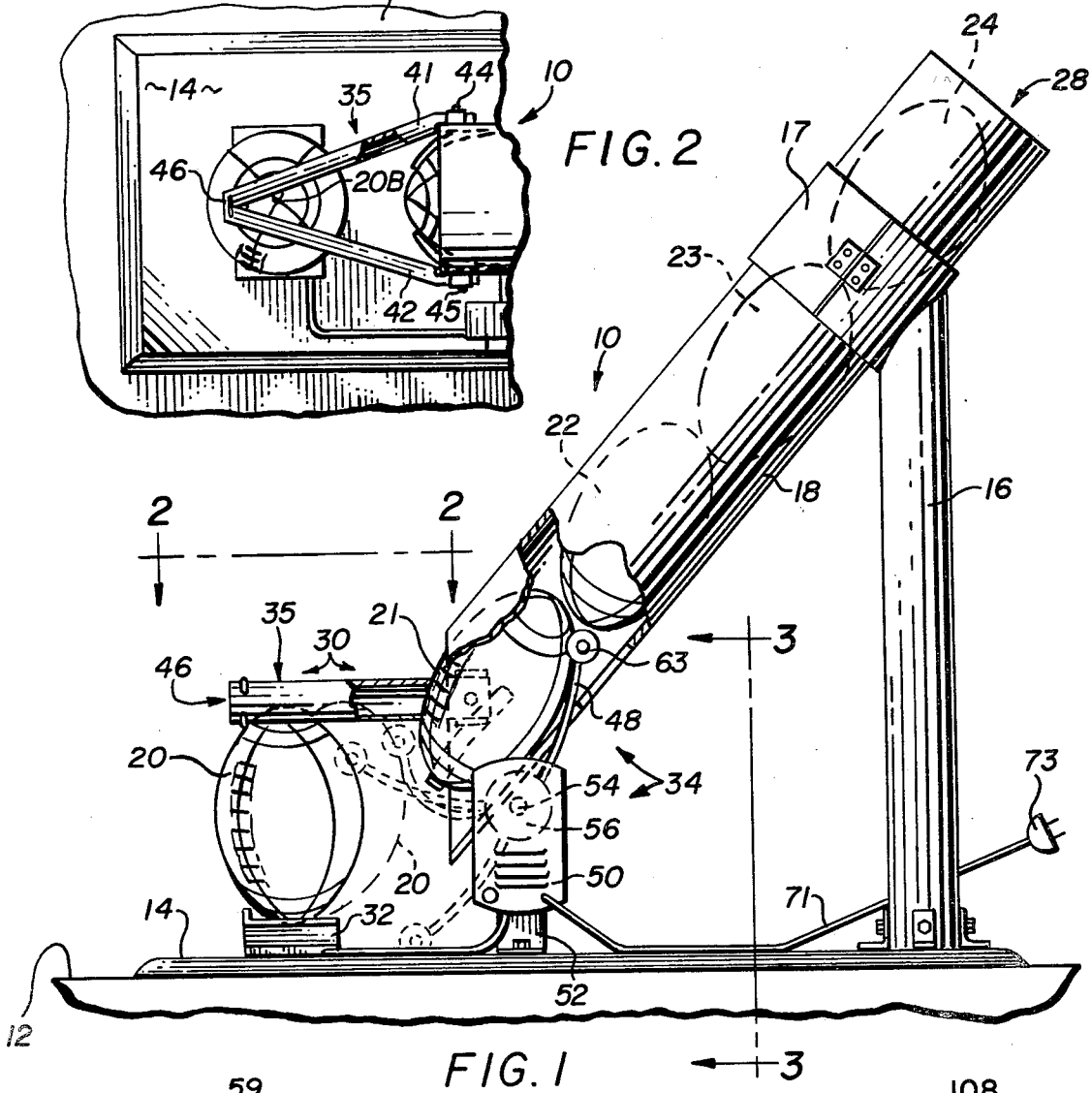
FIG. 1 is a front elevational view of a preferred embodiment of the present invention, with parts thereof broken away or shown in section for clarity, and with moved positions indicated in dashed lines.
Figure 3:
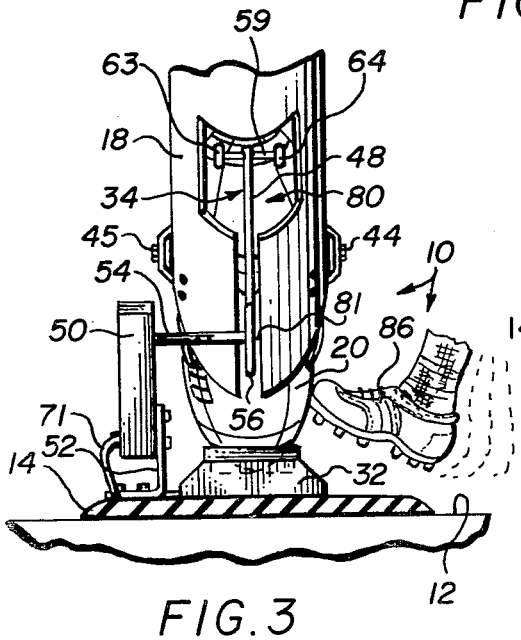
FIG. 3 is a rear plan view taken generally along line 3—3 of FIG. 1, with parts thereof omitted or broken away for brevity.

With initial reference to FIGS. 1–3, automatic football positioning apparatus, generally indicated by the reference numeral 10, is adapted to be disposed upon a playing surface 12. Preferably, apparatus 10 includes a generally planar base 14 which supports a vertically upright stanchion 16. As best viewed in FIG. 1, support stanchion 16 includes a conventional generally tubular clamp 17 adapted to be coupled about the generally tubular hopper 18.

A plurality of conventional footballs 20–24 may be received within hopper 18, being first manually fed into upper open hopper end 28. After footballs 20–24 drop downwardly through hopper 18, they will be contacted by set-up means generally indicated by the reference numeral 30. The set-up means is operable to appropriately position footballs for kicking. Preferably footballs will be disposed substantially vertically upon a pedestal 32 secured to base 14 in spaced relation from stanchion 16. Set-up means 30 preferably includes a football extraction system 34 adapted to serially remove footballs from the hopper and a cooperating, guide arm system 35. Arm 35 is operative to guide footballs into position for kicking upon pedestal 32 in cooperation with the extraction system. Guide arm means 35 preferably includes a pair of halves 41, 42 (FIG. 2) which are preferably pivotally coupled to hopper 18 at opposite sides thereof with fasteners 44, 45. As best viewed in FIG. 2, the guide arm halves 41, 42 converge at a point 46 adapted to be positioned immediately above the pointed top 20B of football 20.

Extracting means 34 preferably includes one or more rotatable resilient fingers 48 which urge footballs out from hopper 18 and move them towards pedestal 32. It will be apparent that because of the converged orientation of guide arm halves 41, 42, the ball will be forced into a generally vertical position relative to pedestal 32 as its upper end rides underneath the guide arm. Preferably the guide arm system 35 is manufactured from relatively heavy tubular rubber or plastic stock. The guide arm system gently contacts the football to maintain it in proper orientation for subsequent kicking. Thus, after the extraction fingers rotate out of contact, the football will nevertheless be maintained in proper position for kicking.

As best seen in FIGS. 1 and 3, the extracting means 34 preferably includes a generally cubicle frame or housing 50 secured above base 14 by a conventional L-bracket 52. Frame 50 houses a conventional electric or pneumatic motor, the output shaft 54 of which communicates with a wheel 56. The resilient fingers 48 are mounted upon wheel 56 to be rotated by same. A transverse terminal strut 59, which is secured to the outermost ends of fingers 48, terminates in a pair of spaced-apart roller wheels 63, 64. Wheels 63, 64 contact and guide footballs in cooperation with convergent guide arm halves 41, 42 previously discussed.

Figure 7:
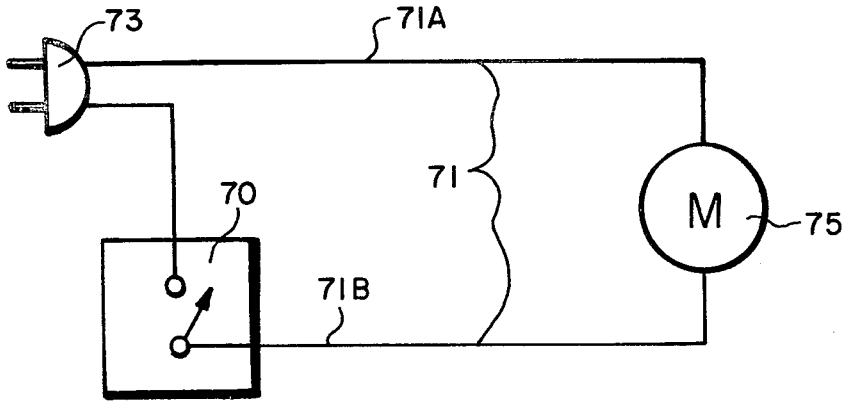
FIG. 7 is an electrical diagram of one method of electrically wiring the embodiment shown FIGS. 3–6.

Preferably the lowermost portion of hopper 18 (FIG. 3) includes an orifice 80 and a communicating, elongated rectangular slot 81 which allows unobstructed passage of the finger 48 and its wheeled strut 59. Once a football 20 is appropriately positioned, it will be apparent that the switch 70 (FIG. 7) will terminate operation of motor 75 until kicking occurs. Thus, after foot 86 (FIG. 3) drives football 20 out from under guide means 35, the extracting means 34 will be initiated when switch 70 closes to drive the motor 75. The set-up means is cycled by switch 70 disposed within pedestal 32 which opens upon football contact. In the electrical embodiment a conventional electrical cord 71 (comprising element 71A, 71B; FIG. 7) receives power from a conventional AC source and electrically operates the motor 75.

Figure 4:
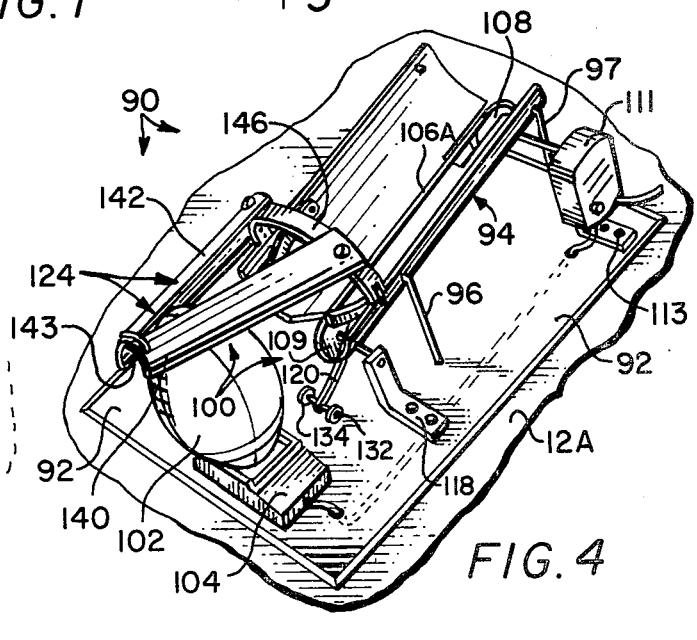
FIG. 4 is an isometric view of an alternative embodiment of the present invention in which balls are forcibly moved through the hopper.
Figure 5:
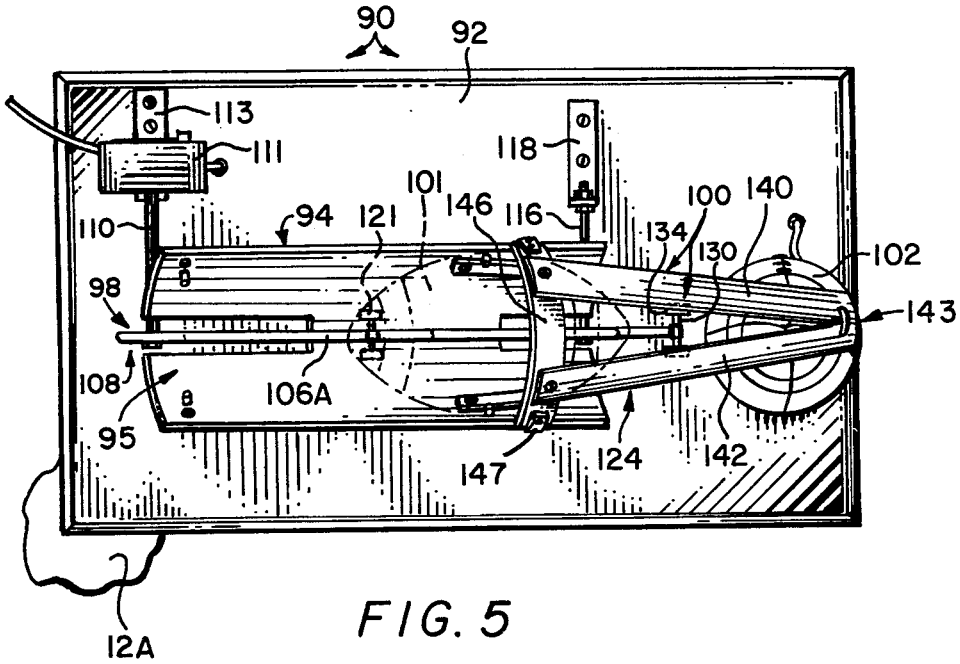
FIG. 5 is an enlarged, top plan view of the embodiment shown in FIG. 4.
Figure 6:
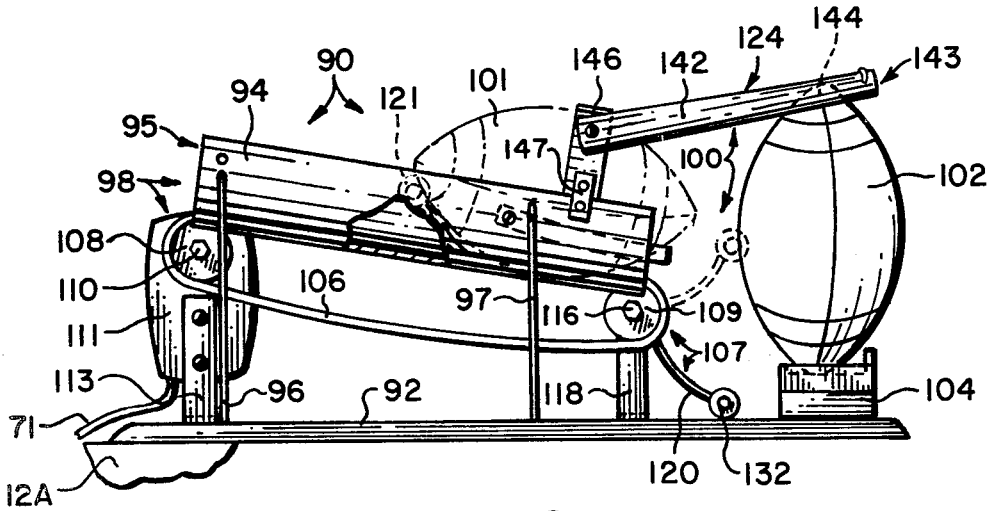
FIG. 6 is a side elevational view of the forced fed embodiment shown in FIGS. 4–5.

Referring now to FIGS. 4–6, an alternative embodiment, generally indicated by the reference numeral 90, is depicted. Embodiment 90 preferably comprises a rigid, lower base 92 adapted to be disposed upon supportive playing surface 12A. Hopper 94 is secured above base 92 by a pair of spaced-apart, vertically upright braces 96, 97, which preferably maintain it at a slight incline with respect to base 92. Hopper 94 is preferably of semi-circular vertical cross section. Alternatively, the hopper 94 may be formed of an elongated tube. Footballs may be manually inserted into hopper 94 by manually inserting them longitudinally into hopper input mouth 95. Footballs will thereafter be forcibly moved through hopper 94 by a feed system, generally designated by the reference numeral 98.

Once footballs emerge from the output of hopper 94, set-up means, generally designated by the reference numeral 100 will orient footballs, such as football 102, upon a pedestal or stand 104, in a proper position for subsequent kicking.

Feed system 98 preferably comprises an endless belt 106, at least a portion 106A of which is disposed within hopper 94 in contact with the football or footballs 101 therewithin. Belt 106 is secured between a pair of conventional, rotatable pulleys 108, 109. Pulley 108 is driven by axle 110 projecting outwardly from motor housing 111 which is preferably secured above base 92 by an L-mount 113. Pulley 109 is rotatably coupled to an idler axle 116 secured above base 92 by an L-Mount 118. It will thus be apparent that upon rotation of belt 106, footballs will be forced through hopper 94 into engagement with the set-up means 100. Motor 75 (FIG. 7) preferably disposed within housing 111 may be controlled by a switch 70 located within pedestal 104. Switch 70 is thus responsive to contact with a football for disabling the motor. A cord 71 will provide necessary AC power.

Set-up means 100 comprises extracting means 107 consisting of a plurality of extracting fingers 120, 121, and a tensioning guide arm system generally designated by the reference numeral 124. The extracting fingers 120, 121 preferably are similar to extracting fingers 48 previously described in conjunction with FIGS. 1–3. Fingers 120, 121 are secured to belt 106. Extracting fingers 120, 121 terminate in a transverse axle 130 which supports spaced-apart football contacting guide wheels 132, 134. Guide arm means 124 preferably comprises a pair of members 140, 142 which converge generally at a point 143, and which guide footballs and orient them properly. Guide arm members 140, 142 are preferably secured at opposite sides of a contoured strut 146 which is secured to opposite sides of the hopper 94 via conventional fasteners 147.

Thus, as the belt 106 rotates, the extracting fingers 120, 121 will rotate within the hopper forcing the footballs 101, or 102 outwardly therefrom. As footballs emerge from the hopper, their uppermost portions will be guided by converging guide arm members 140, 142, and the vertical kickable position occupied by football 102 (FIG. 6) will be assumed. As football contact is made with micro-switch 70, preferably disposed within pedestal 104, motor 75 will be disabled until kicking occurs. Obviously, as switch 70 subsequently closes, finger 121 will thereafter force football 101 into the proper position for kicking.

Figure 9:
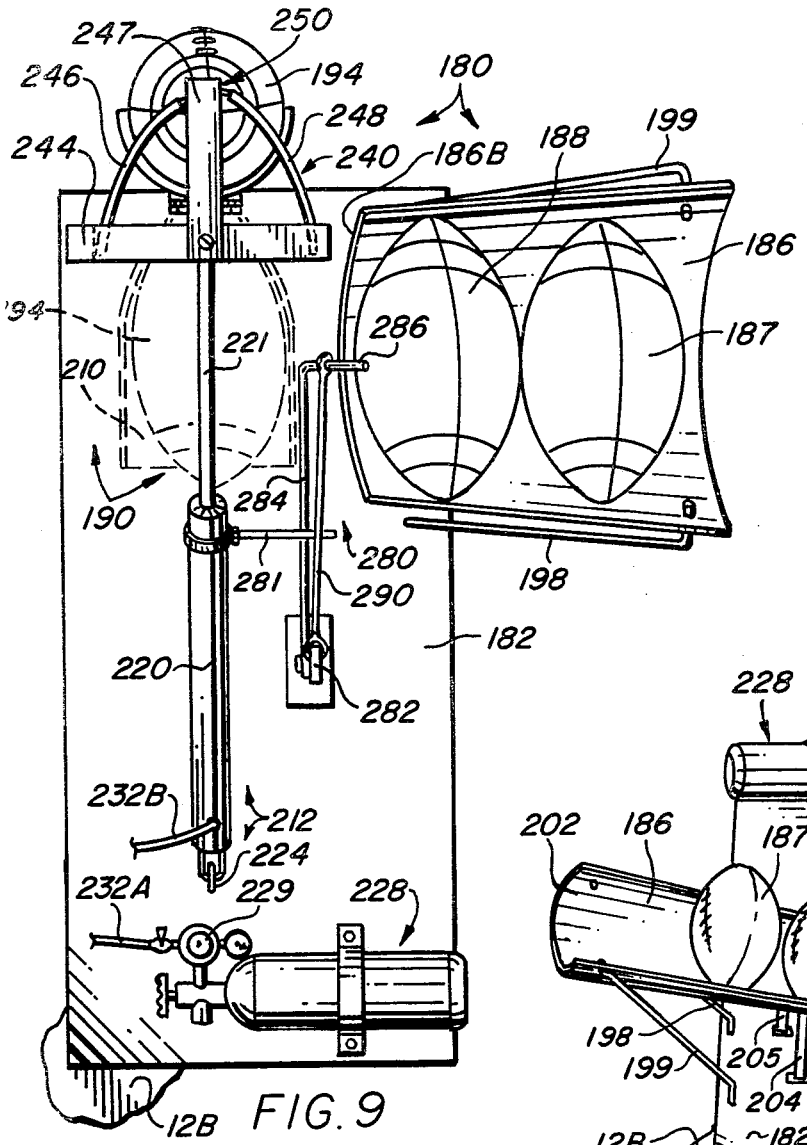
FIG. 9 is an enlarged, top plan view of the embodiment of FIG. 8, with parts thereof shown in dashed lines to indicate moved positions; and, FIG. 10 is a side elevational view of the embodiment of FIGS. 8 and 9, with parts thereof shown in dashed lines to indicate moved positions.
Figure 8:
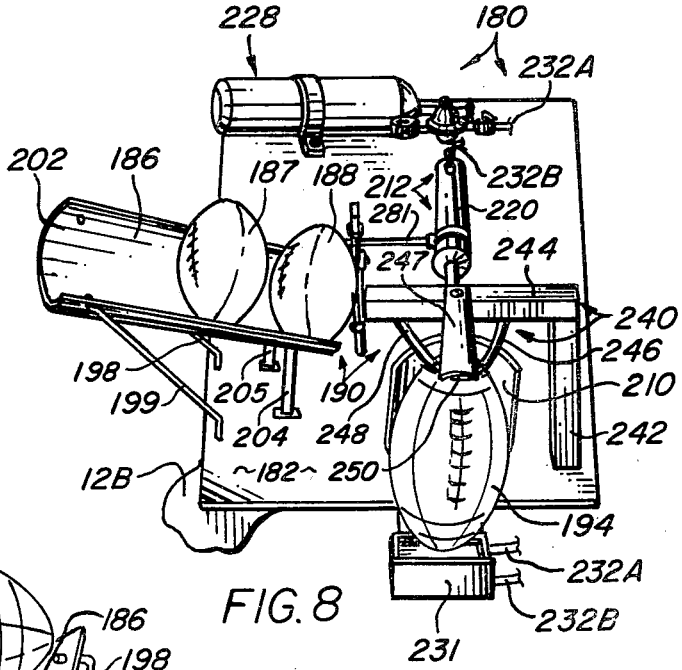
FIG. 8 is an isometric view of a alternative embodiment of the present invention in which a transversely fed hopper is employed in conjunction with pneumatic set-up means.
Figure 10:
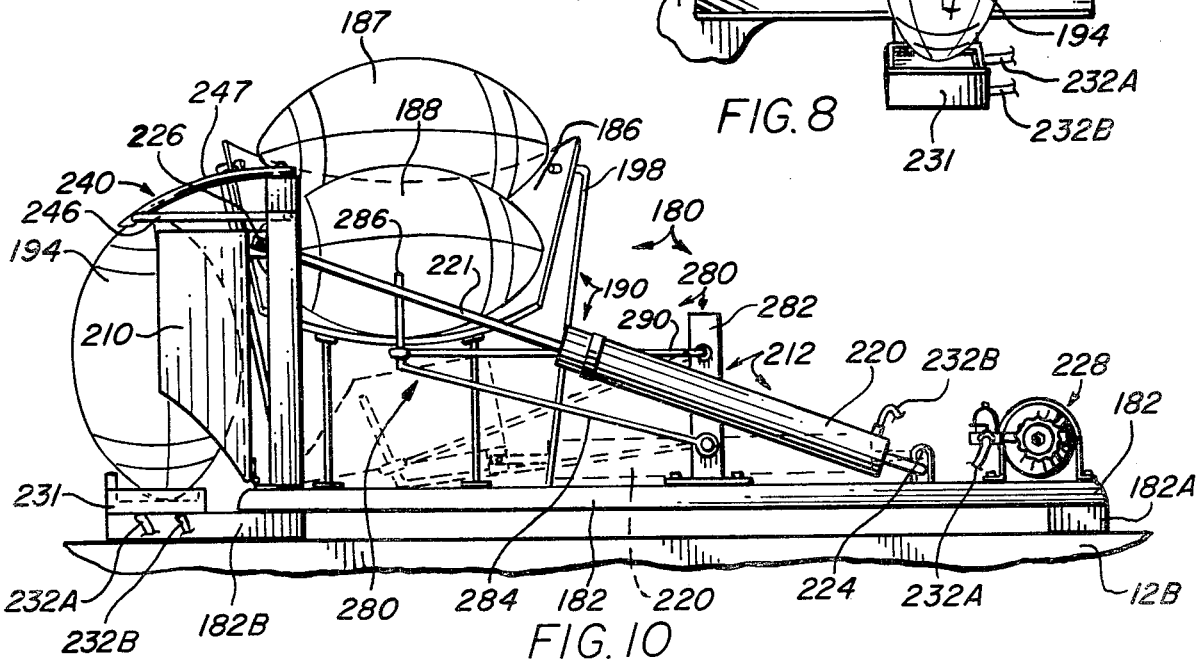

With reference now to FIGS. 8–10, an alternative transversely fed embodiment, generally designated by the reference numeral 180 is illustrated. Embodiment 180 preferably includes a generally planar supportive base 182 adapted to be disposed above playing surface 12B by optional feet 182A, 182B. An elongated hopper 186 transversely feeds footballs 187, 188 into engagement with set-up means generally designated by the reference numeral 190. Thus footballs will be moved from hopper 186 into a kickable position occupied by football 194.

Hopper 186 is of general semi-circular cross section, and it is preferably mounted transversely at an angle of inclination with respect to lower base 182 by a pair of angled, spaced-apart feet 198, 199 which project from its input end 202 at an angle into contact with base 182. The hopper output mouth 186B is preferably secured above base 182 by a pair of conventional stanchions 204, 205. It will thus be apparent that if footballs 187, 188 are first positioned within hopper 186, they will roll downwardly toward base 182 for subsequent engagement with the set-up means 190.

Set-up means 190 preferably comprises a receptor plate 210 and a system 212 for moving the receptor plate between vertical and horizontal positions. Receptor plate 210 is of preferably semi-circular cross-section, and it is adapted to receive a football 194 from the hopper 186. Plate 210 is operated by an elongated, preferably pneumatically powered ram 220 which extends from a pivot anchor 224 secured to base 182 and terminates at its piston rod end in a pivot 226 (FIG. 10) coupled to plate 210. A conventional source 228 of compressed gas is employed to power pneumatic ram 220 in response to signals generated by a pneumatic switch preferably mounted within pedestal 231. Air outputted from regulator 229 on line 232A passes through switch 231 (when no football is on switch 231) and actuates ram 220 via line 232B. This will force receptor plate 210 from a horizontal position, indicated in dashed lines in FIG. 9, to an upright, substantially vertical position in which football 194 is forced upon pedestal 231 beneath guide arm means, generally designated by the reference numeral 240.

Guide arm means 240 preferably comprises an upright, rigid stanchion 242 extending vertically from base 182. Horizontal strut 244 mounts a trio of longitudinally, horizontally outwardly extending braces 246, 247, and 248. Guide arm members 246, 248 converge at a point, generally designated by the reference numeral 250, at the front of member 247. It will thus be apparent that the converging effect of members 246, 248 will cooperate with receptor plate 210 to encourage the vertically upright position suitable for kicking. Football alignment will thus occur automatically in response to forces generated by propulsion from receptor plate 210, as pneumatic ram rod 221 is extended outwardly from ram 220 in response to compressed gases supplied by container 228 along lines 232A, 232B.

Serial deliver of footballs out from hopper 286 into the set-up means is controlled by a gate, generally designated by the reference numeral 280, and an associated gate trigger, generally designated by the reference numeral 281. Gate means 280 preferably comprises a generally vertically upright stanchion 282 which pivotally mounts a rigid, forwardly projecting, generally L-shaped rod 284. Rod 284 terminates in an upturned, generally vertically oriented portion 286 thereof which contacts footballs adjacent hopper mount 186B. When plate 210 assumes the vertical position to force a football into proper position between pedestal 231 and guide arm system 240, gate portion 286 will prevent further footballs 188, 187 from rolling through hopper 186. In this position wherein a football 194 is appropriately set for kicking, trigger 281 will contact elongated spring member 290 to lift gate 286 and block hopper 186.

The spring member 290 preferably comprises an elongated, rubber member extending between gate end 286 and a suitable slot provided in stanchion 282. It will be apparent that a variety of other spring configurations may be successfully employed in conjunction with embodiment 180. After a football has been placed on stand 231 pressure to cylinder 220 will stop, and plate 210 will return to a horizontal position (through gravity or an optional spring). When stand 210 returns to the horizontal position, trigger 281 will open gate 280, and a football will feed into plate 210.

After a football has been kicked out of the apparatus, a pneumatic signal will again be generated to actuate ram rod 221, returning receptor plate 210 to the vertical football positioning stance. Thus receptor plate 210 will be serially loaded, and pneumatic signals will in effect force subsequent footballs 188 into position upon pedestal 231 so that the reloading and kicking process may continue as described.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations.

This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Automatic football positioning apparatus for place kicking practice; the apparatus comprising:

base means adapted to be disposed upon a supportive surface;

hopper means for containing a plurality of footballs, said hopper means secured to said base means;

feed system means for drawing footballs through said hopper means;

set up means for receiving footballs from said hopper means and for automatically positioning footballs from said hopper means in a generally vertical end to end orientation for subsequent kicking, said set-up means comprising:

extraction means for extracting footballs one at a time from said hopper means, and;

guide arm means for orienting footballs from said hopper means in said geneally vertical end-to-end position relative to said base means in cooperation with said extraction means;

switch means responsive to football contact for controlling said set up means and said feed system means.

2. The combination as defined in claim 1 including pedestal means for supporting a football to be kicked from said generally vertical end-to-end position relative to said base means in cooperation with said guide arm means.

3. The combination as defined in claim 2 wherein said switch means is disposed within said pedestal means.

4. The combination as defined in claim 2 wherein said guide arm means comprises a pair of arm member pivotally moveable with respect to said hopper means and converging toward a point from which said football(s) may be kicked.

5. The combination as defined in claim; 2 wherein said feed system means comprises endless belt means including a portion thereof disposed within said hopper means in contact with footballs, said belt means trained about a pair of spaced apart pulleys.

6. The combination as defined in claim 5 wherein said extraction means comprises finger means secured to said belt means for withdrawing footballs from said hopper means and urging them in cooperation with said guide arm means to said generally vertical end-to-end kickable position.

7. The combination as defined in claim 5 including motor means for driving at least one of said pulleys for operating said apparatus and means connecting said switch means to said motor means whereby to cycle said apparatus.

8. The combination as defined in claim 7 including pedestal means for supporting a football to be kicked from said generally vertical end-to-end position relative to said base means in cooperation with said guide arm means.

9. The combination as defined in claim 8 wherein said switch means is disposed within said pedestal means.

10. The combination as defined in claim 9 wherein said guide arm means comprises a pair of arm members pivotally moveable with respect to said hopper means and converging toward a point from which said football(s) may be kicked.

* * * * *